United States Patent [19]

Strobel

[11] Patent Number: 4,829,804

[45] Date of Patent: May 16, 1989

[54] TOOLING FOR CRIMPING EYELET-TYPE INSERTS

[75] Inventor: Burton C. Strobel, Warminster, Pa.

[73] Assignee: SPS Technologies, Inc., Newtown, Pa.

[21] Appl. No.: 107,610

[22] Filed: Oct. 13, 1987

[51] Int. Cl.[4] ..... B21J 15/32

[52] U.S. Cl. ..... 72/391; 72/412; 29/512; 29/522.1; 227/55

[58] Field of Search ..... 29/243, 53, 512, 522 R, 29/523; 227/55, 15, 155, 143; 72/391, 412

[56] References Cited

U.S. PATENT DOCUMENTS 2,717,714 9/1955 Haley ..... 227/15

4,691,552 9/1987 Peterson ..... 72/391

*Primary Examiner*—David Jones

*Attorney, Agent, or Firm*—James D. Dee; Aaron Nerenberg

[57] ABSTRACT

A backing fixture is arranged for use with a pull gun to crimp eyelet type inserts under extemporaneous field conditions. When the desired crimping force is less than the force output of the pull gun, the backing fixture is modified with a spring to limit the crimping force. By compressing the spring prior to crimping operations, its size is decreased and by incorporating means for varying the magnitude of pre-crimp spring compression, the crimping force is made adjustable.

25 Claims, 2 Drawing Sheets

TOOLING FOR CRIMPING EYELET-TYPE INSERTS

BACKGROUND OF THE INVENTION

The installation of eyelet-type inserts, such as grommets, requires that a backing tool be utilized at the preformed end of the insert while the other end thereof is crimped or flared with a forming tool to affix the insert in a hole through a workpiece. A force is translated between the ends of the insert during this crimping operation and a guide means is extended between the backing tool and the forming tool to align that force. The backing tool is separate from the forming tool in conventional eyelet-type insert installation tooling and therefore, a vertical press operation is best suited for such tooling, which of course is not conveniently available under extemporaneous field conditions. Furthermore, the application of excessive force during the crimping operation can cause damage to the insert and/or the workpiece, particularly when the workpiece is thin and/or made of composite epoxy material.

SUMMARY OF THE PRESENT INVENTION

It is the general object of the present invention to provide eyelet-type insert installation tooling which can be utilized conveniently under extemporaneous field conditions.

It is a specific object of the present invention to limit the crimping force of eyelet-type insert installation tooling that performs in accordance with the above mentioned general object.

It is a more specific object of the present invention to variably limit the crimping force of eyelet-type insert installation tooling that performs in accordance with the above mentioned general object.

The present invention is only limited by the appended claims and generally accomplishes these and other objects with a backing tool which fixedly positions the insert while a crimp or flare is applied thereto by the forming tool that is disposed as the nosepiece on a pull gun. In one embodiment, damage to the workpiece and/or insert is precluded by including a spring in the backing tool which limits the crimping force applied by the pull gun. Another embodiment incorporates a means for compressing the spring prior to the crimping operation and thereby decreases the size of the spring required to provide the crimping force limitation. A variable pre-crimp spring compression is utilized in still another embodiment to provide for adjustment of the crimping force limitation. Support for the preferred embodiments is hereinafter set forth in the following description and the attached drawings.

DETAILED DESCRIPTION OF THE PREFERRED EMBODIMENTS

Figure 1:
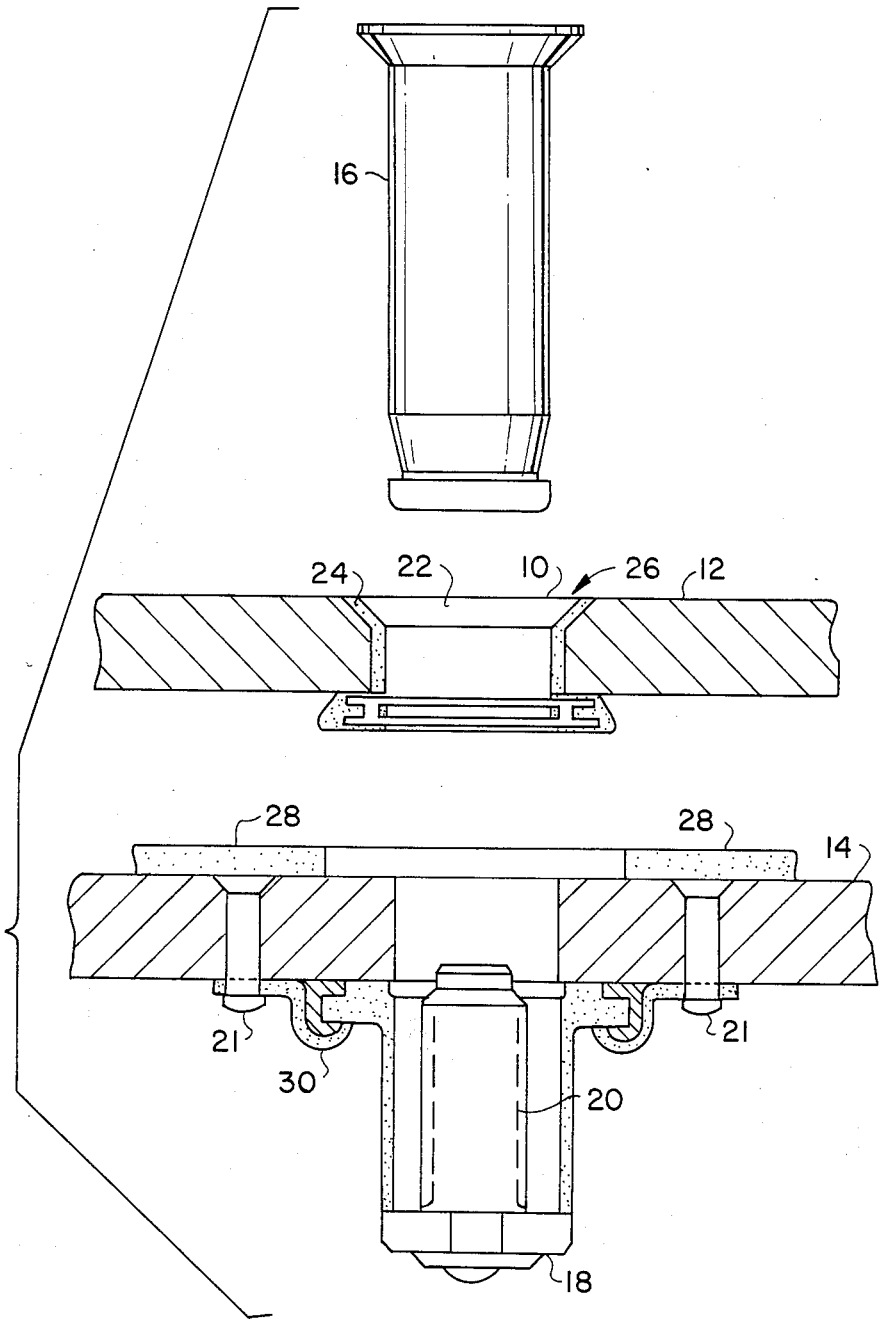
FIG. 1 is a partially sectioned, exploded view of a removable panel and substructure assembly wherein an eyelet-type grommet insert is utilized in the removable panel.

The tooling to which this invention relates is utilized for installing eyelet-type inserts 10, such as the grommet that is affixed through a panel or workpiece 12 in FIG. 1. For purposes of discussion only, panel 12 is removably affixed to a substructure 14 such as an aircraft or aerospace frame, with at least one threaded sleevebolt 16 that passes through the grommet 10 and connects with a receptacle 18 having mating threads 20, which is affixed to the substructure 14 with rivet-type fasteners 21. The grommet 10, which includes a metal inner portion 22 and an elastic or rubber outer portion 24, is installed in the panel 12 with a crimping operation, such as one which crimps or flares an end 26 of the metal portion 22 in the manner shown. A ring gasket 28 and a boot gasket 30 on the receptacle 18 cooperate with the grommet 10 to hermetically seal the interface between the panel 12 and the substructure 14. However, a sealing feature is not an essential aspect of the eyelet-type inserts 10 to which the tooling of this invention relates.

Because the panel 12 is commonly fabricated from very thin and/or light weight materials, such as a graphite-epoxy composite, it can be damaged if excessive and/or misaligned force is applied when the grommet 10 is installed thereinto with the crimping operation. This is particularly true when the grommet 10 is installed with hand tools in the field, where the crimping operation must be performed extemporaneously without the convenience of a vertical press. The adequacy of any crimping operation performed with a hand tool is uncertain because the magnitude and alignment of the crimping force is operator dependent. Therefore, power driven tooling which provides a properly aligned force of predetermined magnitude is desirable for performing such crimping operations in the field. One power tool that is commonly available in the field is a pull gun which provides centrally located gripping jaws within a nosepiece. When the gun is hydraulically or pneumatically actuated, the jaws pull in one direction, while the nosepiece pushes in the other direction. The eyelet-type insert installation tooling of this invention adapts such a pull gun to perform crimping operations during which a properly aligned force of predetermined magnitude is applied.

Figure 2:
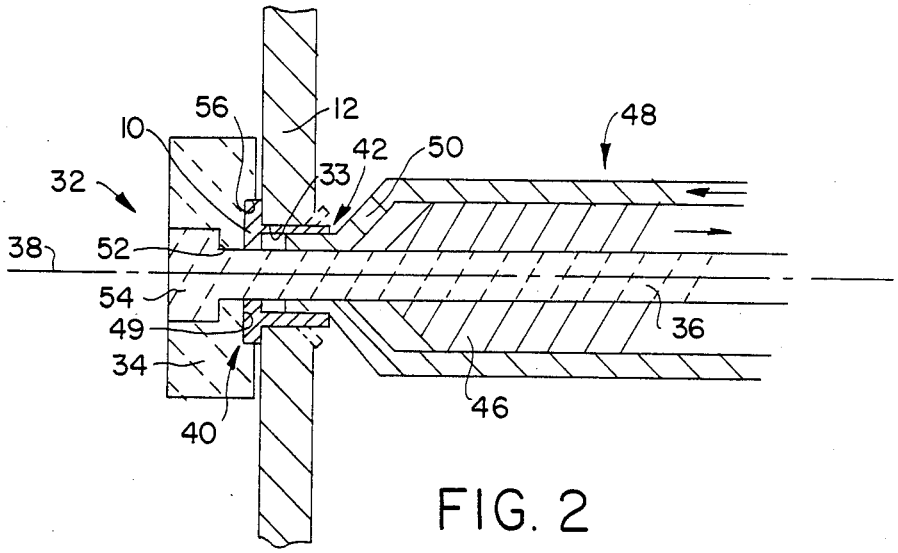
FIG. 2 is a cross sectional view of one installation tooling embodiment of the invention for installing the eyelet-type grommet insert shown in FIG. 1.

Some preferred embodiments of the invention are illustrated in FIG. 2, where a backing fixture 32 is utilized to fix the position of the eyelet-type insert 10 in a hole 33 through the workpiece 12 during the crimping operation. The backing fixture 32 includes a bearing block 34 for fixing the position of the insert 10 and a pin 36 extending from the block 34 along an axis 38 therethrough. Characteristically, the insert 10 has a preformed end 40 and a lead end 42 which is formed by the crimping operation during installation of the insert into workpiece hole 33. Such installation is initiated by directing the pin 36 through the insert 10 from the preformed end 40 thereof and into gripping jaws 46 within a pull gun 48, until the lead end 42 is disposed through the workpiece hole 33 with the preformed end 40 abutting against a flat bearing surface 49 on the block 34, as shown in FIG. 2. Then the gun 48 is actuated to pull the block 34 against the preformed end 40 in one direction while forcing an anvil nosepiece 50 into the lead end 42 to apply a crimp thereto, such as by flaring the lead end 42 in the manner shown by dotted lines in FIG. 2. Of course, the anvil nosepiece 50 may be configured to form the lead end 42 in other ways, such as with a rolled crimp.

The pin 36 may be affixed directly to the bearing block 34 or it may be a separate and distinct part relative thereto, as illustrated in FIG. 2. When the pin 36 and block 34 are separate parts, a hole 52 is disposed through the block 34 along the axis 38 and a head 54 is disposed at one longitudinal end of the pin 36, which is passed through the hole 52 until the head 54 comes to bear against the block 34. A seat 56 may also be configured on the block 34 about the axis 38 to cooperate with the pin 36 for positioning the insert 10 during the crimping operation. This seat 56 may be either raised on the surface of the block 34 or recessed thereinto, as shown in FIG. 2.

Throughout the crimping operation, the full bearing load of the insert 10 against the block 34 is translated to the pull gun 48 through the pin 36 which therefore, aligns the crimping force along the axis 38 through the backing fixture 32 and pull gun 48. Consequently, axis 38 can be directed either vertically or horizontally during the crimping operation or at any inclination therebetween. Although initial alignment of the gun 48 along the axis 38 is generally operator dependent, an aligning influence in this regard is derived from the pull exerted on the pin 36. This is so because the pin 36 extends substantially perpendicular from the flat bearing surface 49 on the block 34 and therefore, its normal alignment is along the axis 38 when the block 34 comes to bear against the workpiece 12. Of course, the pin 36 is essentially rigid and consequently, any pull exerted thereon within approximately 15° of the axis 38 will tend to align automatically therealong. Since alignment of the gun 48 within 15° of the desired pull axis is well within the normal skills of the average pull gun operator, the possibility of a faulty crimp due to gun misalignment is very low. Those skilled in the art will realize without further explanation that to minimize this probability, the rigidity of the pin 36 and the magnitude of the flat bearing surface 49 on block 34 should both be maximized.

Figure 3:
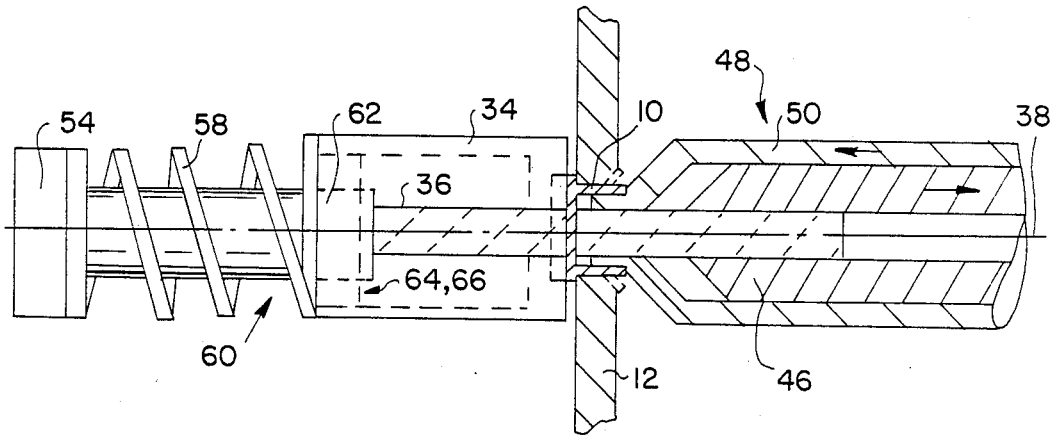
FIG. 3 is a partially sectioned view of another installation tooling embodiment of the invention for installing the eyelet-type grommet insert shown in FIG. 1.

Other preferred embodiments of the invention are illustrated in FIG. 3, where all the elements discussed previously in regard to the embodiments of FIG. 2 are designated with the same numerals as those utilized in FIG. 2. Furthermore, the functionality of the eyelet-type insert installation tooling in FIG. 3 is essentially the same as that discussed previously in regard to the tooling of FIG. 2. However, a coil spring 58 is disposed between the head 54 on the pin 36 and the bearing block 34 in FIG. 3, which is compressed during the crimping operation to limit the crimping force applied by the gun 48. Of course, the force applied to compress the spring 58 during the crimping operation can only be applied by the gun 48. Since the force output of the gun 48 is fixed, the crimping force applied during that operation is reduced in accordance with the size of the spring 58. Furthermore, the distance the spring 58 is compressed during the crimping operation equals the crimping stroke of the anvil nosepiece 50. Since the force required to compress the spring 58 and the compressed distance thereof are related by a constant, the size of the spring 58 is readily determined by calculating this constant as the ratio of the reduction desired in the crimping force applied with the gun 48, over the crimping stroke of the anvil nosepiece 50.

A means 60 for compressing the spring 58 prior to performing the crimping operation may be incorporated to decrease the size of the spring 58 required. The pre-crimp compression of the spring 58 effectively increases the magnitude of the spring constant, without affecting either the magnitude by which the crimping force applied by the gun 48 is reduced or the magnitude of crimping stroke for the anvil nosepiece 50. Of course, the spring 58 would then be selected to have a constant that is numerically equal to the magnitude by which the crimping force applied with the gun 48 is to be reduced, divided by the cumulative total distance of the crimping stroke plus the pre-crimp compression of the spring 58.

One possible implementation of the pre-crimp spring compressing means 60 is shown in FIG. 3 where a sleeve 62 is disposed between the bearing block 34 and the pinhead 54 to establish the separating distance therebetween, with the pin 36 extending therethrough and the spring 58 extending thereover. The pin 36 is captured within either the sleeve 62 or the block 34 to retain it therein, while permitting its movement along the axis 38 in the direction of the pull gun 48. It should be understood without further explanation that the length of the sleeve 62 is determined by the desired pre-crimp, compressed length of the spring 58. In another possible implementation of the pre-crimp, spring compressing means 60, a means 64 is included for varying the effective length of the sleeve 62, to thereby change the pre-crimp, compressed length of the spring 58. One possible implementation for the length varying means 64 is to affix the sleeve 62 to the bearing block 34 with mating threads 66 therebetween. Of course, the length of the sleeve 62 is then shortened to compress the spring 58 by manipulating the mating threads 66 in one direction and is lengthened to relieve compression on the spring 58 by manipulating the mating threads 66 in the other direction. With the length varying means 64, the magnitude by which the crimping force applied with the pull gun 48 is limited, can be adjusted. Therefore, substantially the same backing fixture 32 and pull gun 48 arrangement can be utilized for many different eyelet-type inserts 10, each of which requires a different crimping force.

From the foregoing description it should be apparent that explanations are provided therein as to how the previously stated objects of the invention are accomplished. The full bearing load against the block 34 is translated back to the pull gun 48 through the pin 36 and therefore, the eyelet type insert installation tooling of the invention is functional when aligned at any inclination encountered under extemporaneous field conditions. With the spring 58 disposed between the pin head 54 and the bearing block 34, the crimping force applied by the pull gun 48 to the insert 10 is limited by the force required to compress the spring 58 during the crimping operation. Furthermore, by compressing the length of the spring 58 prior to the crimping operation, the force limiting capability of the spring 58 is enhanced and assuming that the crimping stroke does not change, the crimping force can be adjusted for the installation of different eyelet-type inserts 10, by varying that compressed length.

What is claimed as novel is as follows:

1. A backing fixture for use with a pull gun during crimping operations to install eyelet-type inserts, comprising:

a bearing block for fixing the position of the insert in a hole through a workpiece during crimping operations;

a pin extending out of said block along an axis extending therefrom;

said pin being insertable into gripping jaws of the pull gun and having the full bearing load imposed on said block during crimping operations translated therethrough to the pull gun;

said pin and said block being separate parts, said block having a hole passing therethrough along said axis, said pin having a head disposed at one longitudinal end thereof and being disposable through said hole with said head bearing against said block; and a coil spring being disposed between said head and said block, said spring being compressed during crimping operations to limit the crimping force applied by the pull gun.

2. The backing fixture of claim 1 wherein means disposed between said pin and said block is included for compressing said spring prior to crimping operations and thereby enhance the force limiting capability of said spring.

3. The backing fixture of claim 2 wherein said spring compression means includes a sleeve disposed between said head and said block, with said pin extending therethrough and said spring extending thereover, said sleeve having its length determined by the desired magnitude of pre-crimp spring compression.

4. The backing fixture of claim 3 wherein means is included for varying the length of said sleeve to adjust the magnitude of pre-crimp spring compression.

5. The backing fixture of claim 4 wherein said length varying means includes mating threads on said sleeve and said bearing block, said mating threads being manipulable in one direction to compress the length of said spring and manipulable in the other direction to expand the length of said spring.

6. A backing fixture for use with a pull gun during crimping operations to install eyelet-type inserts, comprising:

a bearing block for fixing the position of the insert in a hole through a workpiece during crimping operations;

a pin extending out of said block along an axis extending therefrom;

said pin being insertable into gripping jaws of the pull gun and having the full bearing load imposed on said block during crimping operations translated therethrough to the pull gun;

a seat for the insert being disposed on said bearing block about said axis, said seat cooperating with said pin to align the insert during crimping operations;

said pin and said block being separate parts, said block having a hole passing therethrough along said axis, said pin having a head disposed at one longitudinal end thereof and being disposable through said hole with said head bearing against said block; and a coil spring being disposed between said head and said block, said spring being compressed during crimping operations to limit the crimping force applied by the pull gun.

7. The backing fixture of claim 6 wherein means disposed between said pin and said block is included for compressing said spring prior to crimping operations and thereby enhance the force limiting capability of said spring.

8. The backing fixture of claim 7 wherein said spring compression means includes a sleeve disposed between said head and said block, with said pin extending therethrough and said spring extending thereover, said sleeve having its length determined by the desired magnitude of pre-crimp spring compression.

9. The backing fixture of claim 8 wherein means is included for varying the length of said sleeve to adjust the magnitude of pre-crimp spring compression.

10. The backing fixture of claim 9 wherein said length varying means includes mating threads on said sleeve and said bearing block, said mating threads being manipulable in one direction to compress the length of said spring and manipulable in the other direction to expand the length of said spring.

11. A backing fixture for use with a pull gun during crimping operations to install eyelet-type inserts, comprising:

a bearing block for fixing the position of the insert in a hole through a workpiece during crimping operations, said block having a hole disposed along an axis extending therethrough;

a pin having a head disposed at one longitudinal end thereof; and a coil spring;

said pin extending through said spring and said hole in said block for insertion into gripping jaws of the pull gun and having the full bearing load imposed on said block during crimping operations translated therethrough to the pull gun, with said spring being compressed during crimping operations to limit the crimping force applied by the pull gun.

12. The backing fixture of claim 11 wherein means disposed between said pin and said block is included for compressing said spring prior to crimping operations and thereby enhance the force limiting capability of said spring.

13. The backing fixture of claim 12 wherein said spring compression means includes a sleeve disposed between said head and said block, with said pin extending therethrough and said spring extending thereover, said sleeve having its length determined by the desired magnitude of pre-crimp spring compression.

14. The backing fixture of claim 13 wherein means is included for varying the length of said sleeve to adjust the magnitude of pre-crimp spring compression.

15. The backing fixture of claim 14 wherein said length varying means includes mating threads on said sleeve and said bearing block, said mating threads being manipulable in one direction to compress the length of said spring and manipulable in the other direction to expand the length of said spring.

16. Tooling for crimping an eyelet-type insert within a hole disposed through a workpiece, comprising;

a backing fixture having a bearing block for fixing the position of the insert in the workpiece hole during crimping operations, and a pin extending out of said block along an axis extending therefrom;

a pull gun having gripping jaws and an anvil nosepiece configured to apply the desired crimp, said gun being operable to move said gripping jaws and said anvil nosepiece in opposite directions;

said pin being insertable into said gripping jaws and having the full bearing load imposed on said block during crimping operations translated therethrough to said pull gun;

said pin and said block being separate parts, said block having a hole passing therethrough along said axis, said pin having a head disposed at one longitudinal end thereof and being disposable through said hole with said head bearing against said block; and a coil spring being disposed between said head and said block, said spring being compressed during crimping operations to limit the crimping force applied by said pull gun.

17. The tooling of claim 16 wherein means disposed between said pin and said block is included for compressing said spring prior to crimping operations and thereby enhance the force limiting capability of said spring.

18. The tooling of claim 17 wherein said spring compression means includes a sleeve disposed between said head and said block, with said pin extending therethrough and said spring extending thereover, said sleeve having its length determined by the desired magnitude of pre-crimp spring compression.

19. The tooling of claim 18 wherein means is included for varying the length of said sleeve to adjust the magnitude of pre-crimp spring compression.

20. The tooling of claim 19 wherein said length varying means includes mating threads on said sleeve and said bearing block, said mating threads being manipulable in one direction to compress the length of said spring and manipulable in the other direction to expandad the length of said spring.

21. Tooling for crimping an eyelet-type insert within a hole disposed through a workpiece, comprising:

a backing fixture having a bearing block for fixing the position of the insert in the workpiece hole during crimping operations, a pin extending out of said block along an axis extending therefrom, and a coil spring; and a pull gun having gripping jaws and an anvil nosepiece configured to apply the desired crimp, said gun being operable to move said gripping jaws and said anvil nosepiece in opposite directions;

said pin extending through said spring and said hole in said block for insertion into said gripping jaws and having the full bearing load imposed on said block during crimping operations translated therethrough to said gun, with said spring being compressed during crimping operations to limit the crimping force applied by said gun.

22. The tooling of claim 21 wherein means disposed between said pin and said block is included for compressing said spring prior to crimping operations and thereby enhance the force limiting capability of said spring.

23. The tooling of claim 22 wherein said spring compression means includes a sleeve disposed between said head and said block, with said pin extending therethrough and said spring extending thereover, said sleeve having its length determined by the desired magnitude of pre-crimp spring compression.

24. The tooling of claim 23 wherein means is included for varying the length of said sleeve to adjust the magnitude of pre-crimp spring compression.

25. The tooling of claim 24 wherein said length varying means includes mating threads on said sleeve and said bearing block, said mating threads being manipulable in one direction to compress the length of said spring and manipulable in the other direction to expand the length of said spring.

* * * * *